US010932501B1

(12) United States Patent
Powell

(10) Patent No.: US 10,932,501 B1
(45) Date of Patent: Mar. 2, 2021

(54) REMOVABLE POUCH FOR ATTACHMENT TO THE BACK OF AN EXERCISE GARMENT

(71) Applicant: Kristina Jo Powell, Pittsford, NY (US)

(72) Inventor: Kristina Jo Powell, Pittsford, NY (US)

( * ) Notice: Subject to any disclaimer, the term of this patent is extended or adjusted under 35 U.S.C. 154(b) by 341 days.

(21) Appl. No.: 16/145,486

(22) Filed: Sep. 28, 2018

Related U.S. Application Data

(60) Provisional application No. 62/566,008, filed on Sep. 29, 2017.

(51) Int. Cl.

| | |
|---|---|
| ***A41C 3/12*** | (2006.01) |
| ***A41C 3/00*** | (2006.01) |
| ***D04B 21/20*** | (2006.01) |
| ***A45C 11/00*** | (2006.01) |
| ***D04B 1/22*** | (2006.01) |
| *A45C 11/18* | (2006.01) |

(52) U.S. Cl.
CPC ..... *A41C 3/0035* (2013.01); *A41C 3/0057* (2013.01); *A41C 3/12* (2013.01); *A45C 11/00* (2013.01); *D04B 1/22* (2013.01); *D04B 21/202* (2013.01); *A45C 11/182* (2013.01); *A45C 2011/002* (2013.01)

(58) Field of Classification Search
CPC ..... A41C 3/0057; A41C 3/12; A41C 3/0035; A45C 11/00; A45C 11/002
USPC ..... 450/89
See application file for complete search history.

(56) References Cited

U.S. PATENT DOCUMENTS

| | | | | | |
|---|---|---|---|---|---|
| 4,705,086 | A * | 11/1987 | O'Neill | A45C 1/04 | 150/134 |
| 4,784,199 | A * | 11/1988 | Wise | A45C 1/08 | 150/134 |
| 4,903,745 | A * | 2/1990 | Roman | A45C 1/04 | 150/134 |
| 5,103,884 | A * | 4/1992 | Roman | A45F 5/02 | 150/134 |
| D378,018 | S * | 2/1997 | Ouellette | D3/215 | |
| D426,703 | S * | 6/2000 | Kojoori | D3/247 | |
| D429,068 | S * | 8/2000 | Kleinsmith | D3/247 | |
| 6,176,761 | B1 | 1/2001 | Underhill | | |
| 6,318,613 | B1 * | 11/2001 | Underhill | A45C 1/04 | 150/134 |
| 6,321,958 | B1 * | 11/2001 | Erdmann | A45C 1/04 | 224/236 |
| 6,517,410 | B1 | 2/2003 | Underhill | | |
| 7,585,200 | B1 | 9/2009 | McLaren | | |
| 9,060,550 | B2 | 6/2015 | Conrad | | |
| D752,858 | S * | 4/2016 | Hamilton | D3/218 | |
| 2006/0206990 | A1 | 9/2006 | Demus | | |
| 2008/0023508 | A1 * | 1/2008 | Harchol | A45F 5/02 | 224/183 |
| 2008/0032600 | A1 | 2/2008 | Updyke | | |
| 2010/0005694 | A1 | 1/2010 | Forte et al. | | |
| 2011/0079619 | A1 | 4/2011 | Lewis | | |
| 2012/0304357 | A1 | 12/2012 | Highfield | | |
| 2013/0098954 | A1 | 4/2013 | Inglis | | |
| 2013/0227764 | A1 | 9/2013 | DiDavide | | |
| 2014/0259298 | A1 | 9/2014 | Esagoff | | |
| 2015/0257457 | A1 | 9/2015 | Kenny | | |

* cited by examiner

*Primary Examiner* — Gloria M Hale
(74) *Attorney, Agent, or Firm* — Phillips Lytle LLP; David L. Principe

(57) ABSTRACT

A removable pouch assembly for attaching a storage pouch to the back of a sports bra.

11 Claims, 5 Drawing Sheets

REMOVABLE POUCH FOR ATTACHMENT TO THE BACK OF AN EXERCISE GARMENT

CROSS-REFERENCE TO RELATED APPLICATION

The present application claims priority benefit of U.S. Provisional Patent Application No. 62/566,008 filed on Sep. 29, 2017, and entitled "Water-resistant Phone Pouch and Clip Inserted in Back of Bra," which is incorporated herein by reference.

TECHNICAL FIELD

The present invention relates generally to the field of exercise gear, and more particularly to a removable pouch for carrying a cell phone during exercise.

BACKGROUND ART

Typically, the options for a woman that wants to carry her phone during exercise include armbands or belts which may be cumbersome or clunky to wear. Both of these alternatives bounce during use, and annoy and chafe the skin of the user. These drawbacks are increased during activities such as jogging or other vigorous exercise. During these activities the user may always be aware of the devices because they bounce or move.

There have been attempts to incorporate pouches and pocket assemblies into women's garments. U.S. Pat. No. 6,517,410 discloses a floating storage pouch for concealing articles within a sports bra.

U.S. Patent Application Publication No. 2012/0304357 discloses a women's garment top with an integrated pocket assembly.

U.S. Pat. No. 6,176,761 discloses a sports bra with a storage pouch.

U.S. Patent Application Publication No. 2015/0257457 discloses a concealed and discreet security pocket worn in the interior of a brassiere cup or bathing suit top.

What is needed is an improved device for carrying items during exercise that eliminates the drawbacks discussed above.

BRIEF SUMMARY OF THE INVENTION

With parenthetical reference to the corresponding parts, portions or surfaces of the disclosed embodiment, merely for the purposes of illustration and not by way of limitation, the present invention provides a pouch (10) that can be clipped onto the back of a sports bra (16) such that the pouch (10) and the items being carried provide minimal distraction during the exercise activity.

In one aspect the invention provides a pouch assembly comprising a pouch (10) constructed of a lightweight, breathable dry handle knit fabric with wicking properties, the pouch (10) having an opening (22) at the top. A liner (37) is disposed inside the pouch (10). The liner (37) is constructed of a waterproof fabric. The liner (37) has an opening at the top. A U-shaped clip (34) is attached to the pouch (10). The U-shaped clip (34) has a first end (40) and a second end (43) opposite the first end (40). One of the first and second ends (40, 43) has a magnetic material disposed thereon, and the other of the first and second ends (40, 43) has a ferromagnetic material disposed thereon.

In another aspect, the invention comprises a method of securing a pouch to a sports bra. The method comprises providing a pouch (10) with an inverted U-shaped clip (34) attached thereto. Next, the method includes providing a sports bra having a pair of cups shaped to receive a woman's breasts. The cups are joined by a cleavage portion of the bra between proximate edges thereof. The cups are also joined by a back portion. Next, the method includes sliding the pouch inside the back portion of the sports bra and supporting the pouch by engagement of the first and second ends of the clip on opposite sides of the back portion such that the pouch is supported substantially in the upper, middle back area of the user.

In another aspect, the invention comprises a sports bra having a pair of cups shaped to receive a woman's breasts. The cups are joined by a cleavage portion of the bra between proximate edges thereof and by a back portion of the bra between distal edges thereof. A lined pouch assembly is removably attached to the back portion of the sports bra. The lined pouch assembly comprises a first elongate panel having a top edge, a bottom edge, a first side edge, and a second side edge disposed opposite from the first side edge. The first elongate panel is constructed of a waterproof material.

A second elongate panel having a top edge, a bottom edge, a first side edge, and a second side edge is disposed opposite from the first side edge. The second elongate panel is constructed of a waterproof material. The second elongate panel is attached to the first elongate panel along the bottom edge, left side edge and right side edge to form a first pouch member having an opening bordered by the top edge of the first elongate panel and the top edge of the second elongate panel. The first pouch member has an inner surface and an outer surface. The inner surface forms the inside surface of the lined pouch assembly.

A third elongate panel having a top edge, a bottom edge, a first side edge, and a second side edge is disposed opposite from the first side edge. The third elongate panel is constructed of a microfiber material having wicking properties. A fourth elongate panel having a top edge, a bottom edge, a first side edge, and a second side edge is disposed opposite from the first side edge. The fourth elongate panel is constructed of a microfiber material having wicking properties.

The third and fourth elongate panels are attached to each other along the bottom edges and the left and right side edges to form a second pouch member having an opening bordered by the top edge of the third elongate panel and the top edge of the fourth elongate panel. The second pouch member has an inner surface and an outer surface. The outer surface forms the outside surface of the lined pouch assembly.

The first pouch member is disposed inside the second pouch member.

A zipper assembly has a first tape supporting a first set of teeth, a second tape supporting a second set of teeth, a slider body, and a pull tab. The top edges of the first and third elongate panels are joined through attachment to the first tape, and the top edges of the second and fourth elongate panels are joined through attachment to the second tape.

The zipper assembly is configured and arranged to provide a closure for the top openings of the first and second pouches.

An elongate clip has a body extending from a first end to a second end opposite the first end. The clip is attached to one of the third and fourth elongate panels. The clip is capable of folding about a midportion of the body such that the first end and the second end are disposed near each other.

The first and second end are configured and arranged to detachably attach to each other to secure the lined pouch assembly to a strap on a garment worn by the user. One of the first and second ends of the clip have a magnet thereon and the other of the first and second ends of the clip have a ferromagnetic material thereon.

The pouch assembly has an outside surface formed from a microfiber material with wicking properties and has an inside surface formed from a water proof material and has a closeable, top opening configured and arranged to receive items for storage inside the double walled pouch assembly.

The lined pouch assembly is removably attached to the back portion by placing the first and second ends of the clip on opposite sides of the back portion of the sports bra such that they are disposed near and held together by the magnetic attraction such that the lined pouch assembly stays in position in the upper middle back area of the user during activity by the user.

DESCRIPTION OF THE PREFERRED EMBODIMENTS

Figure 1:
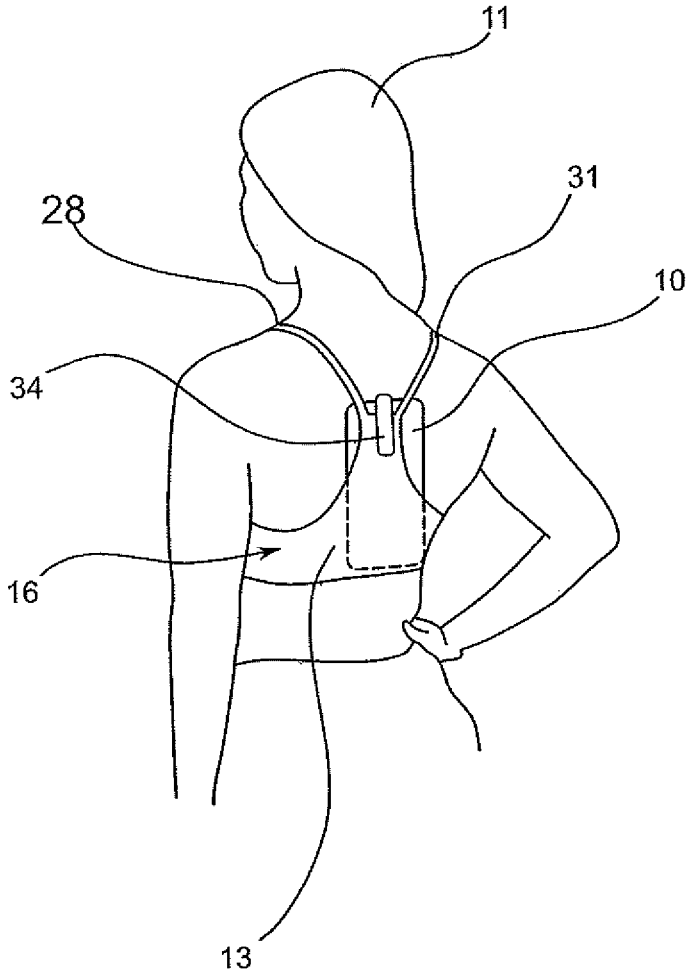
FIG. 1 is a perspective view of the removable pouch of the invention shown mounted to the back portion of a sports bra worn by a user.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, debris, etc.) together with the specification, and are to be considered a portion of the entire written description of this invention. As used in the following description, the terms "horizontal", "vertical", "left", "right", "up" and "down", as well as adjectival and adverbial derivatives thereof, (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or of rotation, as appropriate.

Referring now to the drawings, and more particularly to FIG. 1 thereof, a pouch 10 may be removably mounted to the back portion 13 of a sports bra 16 as shown. The pouch 10 has a clip 19 attached thereto as will be described in greater detail herein. The pouch 10 has a top opening 22 (best shown in FIG. 4). The top opening 22 may be provided with a closure such as a zipper 25 or the like. The pouch 10 opens at the top to receive valuables such as cell phones, keys, wallets, money, credit cards, or the like. The sports bra 16 typically has a pair of shoulder straps 28 and 31 that connect to the back portion 13. As shown, the pouch 10 is supported inside the sports bra 16 with only a clip 34 disposed on the outside of the sports bra 16. As described in greater detail herein the clip 34 may be provided with a magnet and a ferromagnetic material at opposite ends such that the end of the clip 34 inside the sports bra 16 is connected to the end of the clip outside the sports bra 16 without having a closure or fastener extending through the garment. The position of the pouch 10 in the upper middle back of the user 11 provides for free use of the hands and eliminates the need for having anything extending from the arms or shoulders that could snag on something or move and shift during physical activities.

Figure 2:
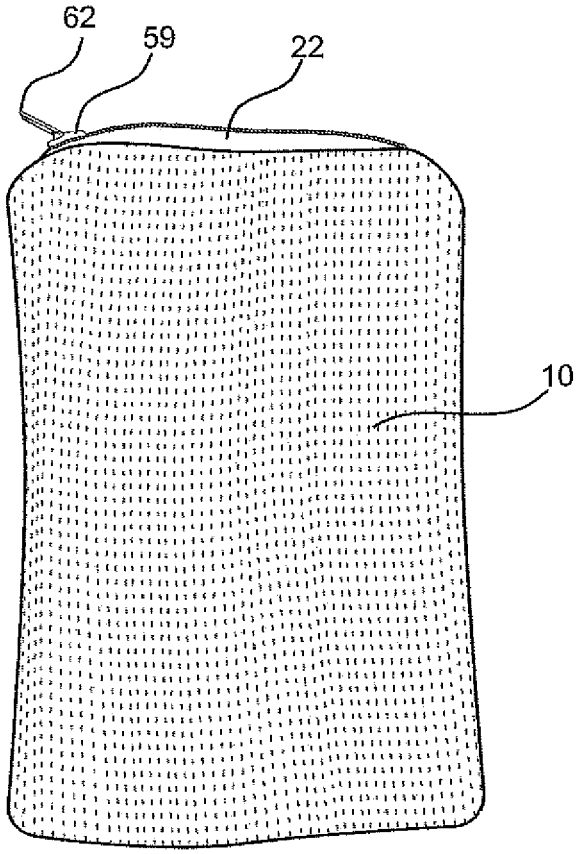
FIG. 2 is an elevational view of one side of the removable pouch.

Turning to FIG. 2, in a first embodiment a zipper pouch 10 with a lining 37 (FIG. 4) is shown. The lined pouch 10 may be constructed from four pieces of fabric and a zipper assembly (i.e., tape, teeth, slider body, and pull tab) as will be evident to those of ordinary skill in the art based on this disclosure. The top edge of one of the pieces of the pouch fabric and the top edge of the one of the pieces of liner fabric may be sewn to a first tape on one side of the zipper assembly and the top edges of the remaining pieces may be sewn to a second tape on the other side of the zipper assembly. Next, the remaining edges of the pouch fabric pieces are sewn together and the remaining edges of the two liner fabric pieces are sewn together.

The fabric for the liner 37 is preferably polyurethane laminate ("PUL") which is a waterproof material. The lined pouch assembly of the invention is intended to be used for storage of electronic items such as cell phones so it is desirable that they do not become wet from exposure to sweat, rain or snow. The same applies for credit cards and cash that may be stored in the pouch 10.

The fabric for the outside of the pouch 10 may comprise a dry handle knit that is lightweight, breathable, and has wicking properties. The fabric wicks sweat away from the pouch and also prevents the pouch from heating up the back of the user 11 during strenuous physical activities such as running.

The pouch 10 and liner 37 of the present invention may be constructed of other materials besides four rectangular panels. The alternate materials may eliminate some of the sewing. For example, the invention may be constructed from tubular fabrics that may comprise two tubular pieces of fabric that would only require sewing or closures at the two open ends.

Figure 3A:
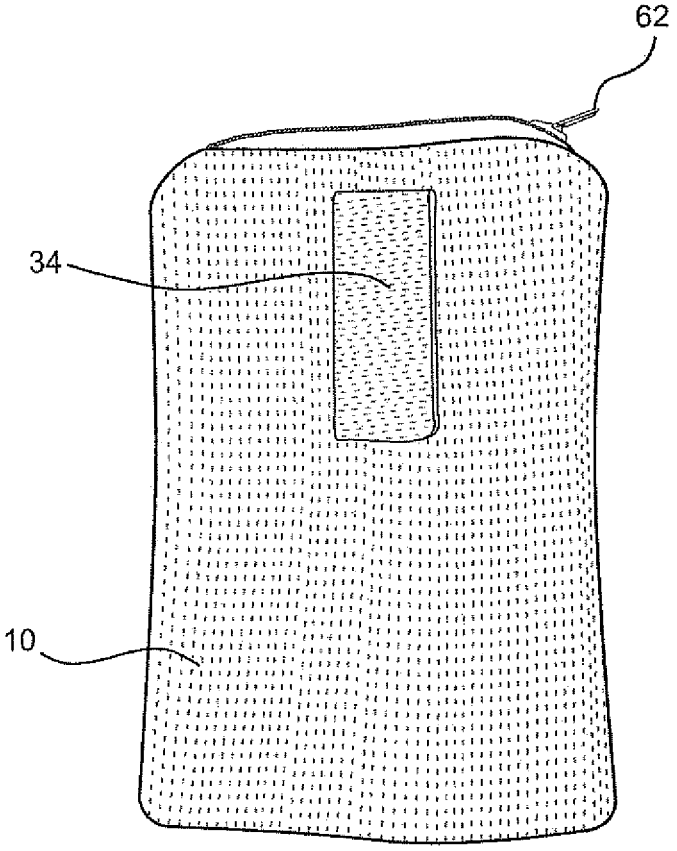
FIG. 3A is an elevational view of the side of the removable pouch opposite from the side shown in FIG. 2.
Figure 3B:
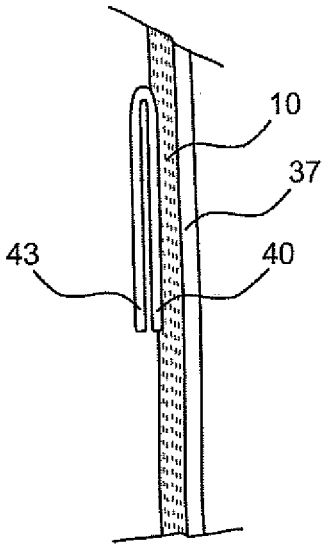
FIG. 3B is a side elevational view of the clip of the present invention.

Turning to FIGS. 3A-3B, the clip 34 may be formed from an elongate member having a first end 40 and a second end 43 disposed opposite from the first end 40. One of the first and second ends 40, 43 may be provided with magnetic material and the other of the first and second ends 40, 43 may be provided with a ferromagnetic material. The clip 34 is capable of bending about a mid-portion 46 such that the first end 40 and the second end 43 are capable of being brought together and held together by means of the magnetic attraction of the two ends 40, 43. In this manner the clip 34 can be attached to the sports bra 16 without penetrating the fabric of the sports bra 16.

Figure 4:
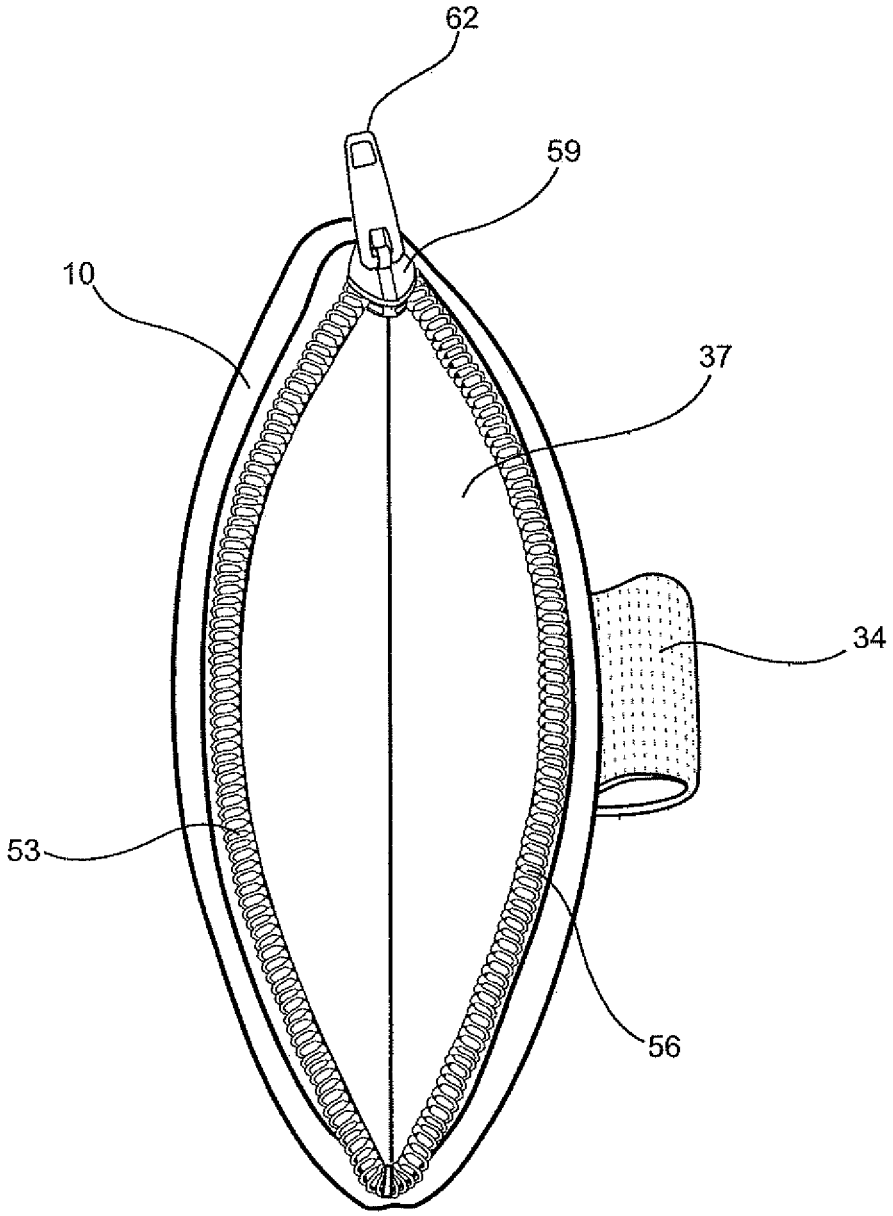
FIG. 4 is a top plan view of the removable pouch of the present invention shown in the open position.

In FIG. 4, the inside of the pouch 10 is shown with the liner 37 being formed from two panels joined along a seam 50 at the bottom. The top opening 22 may be closed by a zipper assembly including teeth 53, 56 on opposite sides and having a slider body 59 for engaging with the teeth 53, 56 to close the opening by means of a pull tab 62.

Figure 5:
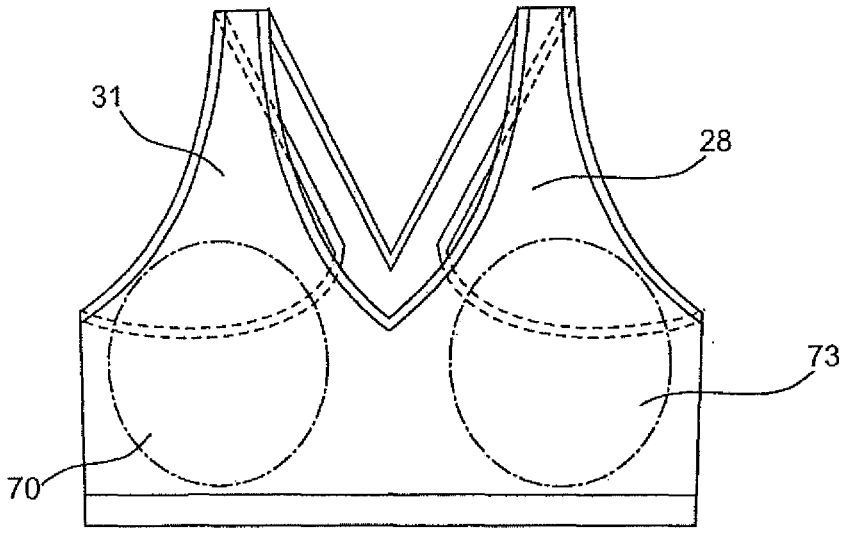
FIG. 5 is a front elevational view of a sports bra.
Figure 6:
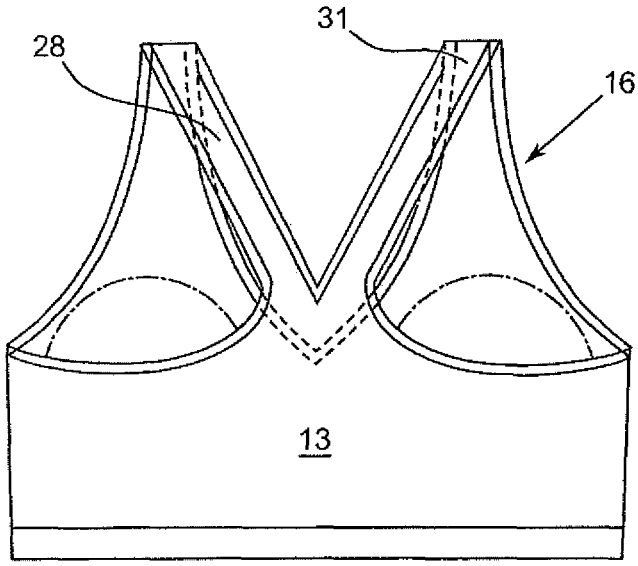
FIG. 6 is a rear elevational view of a sports bra.

Turning to FIG. 5, a sports bra 16 may comprise a pair of cups 70, 73 shaped to receive a woman's breasts, said cups 70, 73 being joined by a cleavage portion 76 of the bra 16 between proximate edges thereof and by a back portion 13 of the bra 16 between distal edges thereof. The sports bra 16 may be supported by shoulder straps 28, 31.

In use a woman that is a runner or a biker, or just looking for a hands free way to walk a dog or chase kids at a playground would insert their phone, keys, money, credit cards, or the like into the pouch and zip it closed. Next, the woman holds the pouch in her hand with the clip facing her. She reaches her arm and the pouch over her head. With the other hand, the woman slightly lifts her bra strap and then she slides the pouch inside the middle back of the bra structure. Once the top edge of the back portion of the bra reaches the inside of the clip, the ends of the clip hold the pouch in position by means of magnetic properties. Once the pouch is positioned inside the bra structure, a portion of the clip extends downward outside of the bra to hold the pouch in position.

The present invention contemplates that many changes and modifications may be made. Therefore, while the presently-preferred form of the Pouch has been shown and described, and several modifications and alternatives discussed, persons skilled in this art will readily appreciate that various additional changes and modifications may be made without departing from the spirit of the invention, as defined and differentiated by the following claims.

The invention claimed is:

1. A pouch assembly, comprising:

a pouch constructed of a lightweight, breathable dry handle knit fabric with wicking properties, the pouch having an opening at a top of the pouch;

a liner disposed inside the pouch, the liner constructed of a waterproof fabric, the liner having an opening at a top of the liner;

a U-shaped clip attached to the pouch, the U-shaped clip having a first end and a second end opposite the first end, one of the first and second ends having a magnetic material disposed thereon and the other of the first and second ends having a ferromagnetic material disposed thereon; and, wherein the pouch assembly is removably attached to a back portion of a sports bra by placing the first and second ends of the clip on opposite sides of the back portion of the sports bra such that they are disposed near and held together by the magnetic attraction such that the pouch assembly is configured to stay in position in an upper middle back area of a user during activity by the user.

2. The pouch assembly of claim 1, wherein the pouch and liner are formed from a first panel having a top edge, a bottom edge, a first side edge, and a second side edge disposed opposite from the first side edge, the first elongate panel constructed of a waterproof material, a second panel having a top edge, a bottom edge, a first side edge, and a second side edge disposed opposite from the first side edge, the second panel constructed of a waterproof material, the second panel attached to the first panel along the bottom edge, left side edge and right side edge to form a liner having an opening bordered by the top edge of the first panel and the top edge of the second panel, the liner having an inner surface and an outer surface, the inner surface forming an inside surface of the pouch assembly;

a third panel having a top edge, a bottom edge, a first side edge, and a second side edge disposed opposite from the first side edge, the third panel constructed of a lightweight, breathable, wicking microfiber material;

a fourth panel having a top edge, a bottom edge, a first side edge, and a second side edge disposed opposite from the first side edge, the fourth panel constructed of a lightweight, breathable, wicking microfiber material;

the third and fourth panels attached to each other along the bottom edges and the left and right side edges to form a pouch having an opening bordered by the top edge of the third panel and the top edge of the fourth panel, the pouch having an inner surface and an outer surface, the outer surface forming an outside surface of the pouch assembly; and wherein the liner is disposed inside the pouch.

3. The pouch assembly of claim 2, further comprising a zipper assembly having a first tape supporting a first set of teeth, a second tape supporting a second set of teeth, a slider body, and a pull tab, the top edges of the first and third panels joined through attachment to the first tape and the top edges of the second and fourth panels joined through attachment to the second tape.

4. The pouch assembly of claim 2, wherein the first and second panels are constructed of polyurethane laminate.

5. A removable lined pouch assembly, comprising:

a first panel having a top edge, a bottom edge, a first side edge, and a second side edge disposed opposite from the first side edge, the first elongate panel constructed of a waterproof material, a second panel having a top edge, a bottom edge, a first side edge, and a second side edge disposed opposite from the first side edge, the second panel constructed of a waterproof material, the second panel attached to the first panel along the bottom edge, left side edge and right side edge to form a liner having an opening bordered by the top edge of the first panel and the top edge of the second panel, the liner having an inner surface and an outer surface, the inner surface forming a inside surface of the lined pouch assembly;

a third panel having a top edge, a bottom edge, a first side edge, and a second side edge disposed opposite from the first side edge, the third panel constructed of a lightweight, breathable, wicking microfiber material;

a fourth panel having a top edge, a bottom edge, a first side edge, and a second side edge disposed opposite from the first side edge, the fourth panel constructed of a lightweight, breathable, wicking microfiber material;

the third and fourth panels attached to each other along the bottom edges and the left and right side edges to form a pouch having an opening bordered by the top edge of the third panel and the top edge of the fourth panel, the pouch having an inner surface and an outer surface, the outer surface forming an outside surface of the lined pouch assembly;

the liner disposed inside the pouch;

a zipper assembly having a first tape supporting a first set of teeth, a second tape supporting a second set of teeth, a slider body, and a pull tab, the top edges of the first and third panels joined through attachment to the first tape and the top edges of the second and fourth panels joined through attachment to the second tape;

the zipper assembly configured and arranged to provide a closure for the top openings of the liner and the pouch;

an elongate clip having a body extending from a first end to a second end opposite the first end, the clip attached to one of the third and fourth panels, the clip capable of folding about a midportion of the body such that the first end is disposed near the second end, the first end configured and arranged to detachably attach to the second end to secure the lined pouch assembly to a strap on a garment configured to be worn by a user, wherein one of the first and second ends of the clip have a magnet thereon and the other of the first and second ends of the clip have a ferromagnetic material thereon.

6. The removable lined pouch assembly of claim 5 wherein the first and second panels are constructed of polyurethane laminate.

7. The removable lined pouch assembly of claim 5 wherein the third and fourth panels are constructed of a dry handle knit.

8. The removable lined pouch assembly of claim 7 wherein the pouch is removably attached to a back portion of a sports bra such that the pouch is configured to be positioned in a upper middle back portion of a user.

9. A combination, comprising:

a sports bra having a pair of cups shaped to receive a woman's breasts, said cups being joined by a cleavage portion of the bra between proximate edges thereof and by a back portion of the bra between distal edges thereof; and, a lined pouch assembly removably attached to the back portion of the sports bra, the lined pouch assembly comprising a first elongate panel having a top edge, a bottom edge, a first side edge, and a second side edge disposed opposite from the first side edge, the first elongate panel constructed of a waterproof material, a second elongate panel having a top edge, a bottom edge, a first side edge, and a second side edge disposed opposite from the first side edge, the second elongate panel constructed of a waterproof material, the second elongate panel attached to the first elongate panel along the bottom edge, left side edge and right side edge to form a first pouch member having an opening bordered by the top edge of the first elongate panel and the top edge of the second elongate panel, the first pouch member having an inner surface and an outer surface, the inner surface forming an inside surface of the double walled pouch assembly;

a third elongate panel having a top edge, a bottom edge, a first side edge, and a second side edge disposed opposite from the first side edge, the third elongate panel constructed of a microfiber material having wicking properties;

a fourth elongate panel having a top edge, a bottom edge, a first side edge, and a second side edge disposed opposite from the first side edge, the fourth elongate panel constructed of a microfiber material having wicking properties;

the third and fourth elongate panels attached to each other along the bottom edges and the left and right side edges to form a second pouch member having an opening bordered by the top edge of the third elongate panel and the top edge of the fourth elongate panel, the second pouch member having an inner surface and an outer surface, the outer surface forming an outside surface of the double walled pouch assembly;

the first pouch member disposed inside the second pouch member, a zipper assembly having a first tape supporting a first set of teeth, a second tape supporting a second set of teeth, a slider body, and a pull tab, the top edges of the first and third elongate panels joined through attachment to the first tape and the top edges of the second and fourth elongate panels joined through attachment to the second tape;

the zipper assembly configured and arranged to provide a closure for the top openings of the first and second pouches;

an elongate clip having a body extending from a first end to a second end opposite the first end, the clip attached to one of the third and fourth elongate panels, the clip capable of folding about a midportion of the body such that the first end is disposed near the second end, the first end configured and arranged to detachably attach to the second end to secure the double walled pouch assembly to a strap on a garment configured to be worn by a user, wherein one of the first and second ends of the clip have a magnet thereon and the other of the first and second ends of the clip have a ferromagnetic material thereon; and, wherein the lined pouch assembly has an outside surface formed from a microfiber material with wicking properties and has an inside surface formed from a water proof material and has a closeable, top opening configured and arranged to receive items for storage inside the double walled pouch assembly; and, wherein the lined pouch assembly is removably attached to the back portion by placing the first and second ends of the clip on opposite sides of the back portion of the sports bra such that they are disposed near and held together by the magnetic attraction such that the lined pouch assembly is configured to stay in position in an upper middle back area of a user during activity by the user.

10. A method of securing a pouch to a sports bra, the method comprising:

providing a pouch with an inverted U-shaped clip attached thereto;

providing a sports bra having a pair of cups shaped to receive a woman's breasts, said cups being joined by a cleavage portion of the bra between proximate edges thereof and by a back portion of the bra between distal edges thereof;

sliding the pouch inside the back portion of the sports bra and supporting the pouch by engagement of the first and second ends of the clip on opposite sides of the back portion such that the pouch is configured to be supported substantially in a upper, middle back area of a user.

11. The method of claim 10, wherein the clip has a body with a first end and a second end, the clip being capable of folding about a midportion of the body such that the first end is disposed near the second end, the first end configured and arranged to detachably attach to the second end to secure the pouch assembly to a strap on a garment configured to be worn by a user, wherein one of the first and second ends of the clip have a magnet thereon and the other of the first and second ends of the clip have a ferromagnetic material thereon.

* * * * *